US010258118B2

(12) United States Patent
Rydlewicz

(10) Patent No.: US 10,258,118 B2
(45) **Date of Patent: *Apr. 16, 2019**

(54) OVAL SHAPED DIAMOND CUT HAVING HEARTS AND ARROWS PATTERN

(71) Applicant: Worldwide Diamond Trademarks, Ltd., Vancouver, BC (CA)

(72) Inventor: Roni Rydlewicz, Rhode-Saint-Genese (BE)

(73) Assignee: WORLDWIDE DIAMOND TRADEMARKS LTD., Vancouver, BC (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/740,669

(22) Filed: Jun. 16, 2015

(65) Prior Publication Data

US 2016/0366993 A1 Dec. 22, 2016

(51) Int. Cl.
*A44C 17/00* (2006.01)

(52) U.S. Cl.
CPC ..... *A44C 17/001* (2013.01)

(58) Field of Classification Search
CPC ..... A44C 17/00; A44C 17/001
See application file for complete search history.

(56) References Cited

U.S. PATENT DOCUMENTS

D734,200 S * 7/2015 Rydlewicz ..... D11/90
D738,778 S * 9/2015 Rydlewicz ..... D11/90
D763,122 S * 8/2016 Rydlewicz ..... D11/90
2008/0271485 A1* 11/2008 Rydlewicz ..... A44C 17/001 63/32
2008/0271486 A1* 11/2008 Rydlewicz ..... A44C 17/001 63/32
2008/0271487 A1* 11/2008 Rydlewicz ..... A44C 17/001 63/32
2008/0271488 A1* 11/2008 Rydlewicz ..... A44C 17/001 63/32

(Continued)

FOREIGN PATENT DOCUMENTS

EP 1 741 359 A1 1/2007
WO 2012/156336 A1 11/2012

OTHER PUBLICATIONS

Search Report in European Patent Application No. 16174874.4, dated Dec. 6, 2016.

*Primary Examiner* — Emily M Morgan
(74) *Attorney, Agent, or Firm* — Scarinci Hollenbeck

(57) ABSTRACT

An oval shaped diamond, adapted to display a hearts and arrows pattern when exposed to light characteristic of the hearts and arrows pattern in a round diamond, comprising: an oval shape having two long sides symmetrical to each other, two short sides symmetrical to each other and four diagonal sides symmetrically located between the long sides and the short sides respectively, eight main crown facets, eight main pavilion facets, sixteen pavilion half facets; a uniform girdle of varying thickness separating the crown and pavilion facets, twelve subsidiary pavilion facets and eight crown star facets with each crown star facet including two facet sections of equal size and geometry on each of the two long and two short sides of the oval shaped diamond and two facet sections of non-equal size and geometry in each of the four diagonal or shoulder sides of the oval shaped diamond.

7 Claims, 4 Drawing Sheets

(56) References Cited

U.S. PATENT DOCUMENTS

| | | | | |
|---|---|---|---|---|
| 2009/0178438 | A1* | 7/2009 | Rydlewicz | A44C 17/001 63/32 |
| 2013/0019636 | A1* | 1/2013 | Rydlewicz | A44C 17/001 63/32 |
| 2014/0026616 | A1* | 1/2014 | Rydlewicz | A44C 17/001 63/32 |

* cited by examiner

OVAL SHAPED DIAMOND CUT HAVING HEARTS AND ARROWS PATTERN

FIELD OF THE INVENTION

The present invention relates to an improved oval shaped diamond which generates a hearts and arrows pattern when exposed to light with the shape of the hearts and arrows pattern more closely duplicating the shape of the hearts and arrows generated by an ideal polished round cut diamond.

BACKGROUND OF THE INVENTION

A hearts and arrows pattern is successfully generated by a round cut diamond when exposed to light, provided the round diamond is cut into a nearly perfect round shape possessing equal and symmetrically cut facets with its angular proportions polished within relatively narrow ranges. Unlike the round shaped diamond an oval shaped diamond, by definition, has a non-symmetrical geometry with two long sides and two short sides. Applicant has nevertheless been able to polish an oval shaped diamond to generate a hearts and arrows pattern when subjected to light as shown and taught in U.S. Pat. No. 7,878,025 the disclosure of which is incorporated herein by reference. The hearts and arrows pattern generated in the oval shaped diamond taught in U.S. Pat. No. 7,878,025 simulates the hearts and arrows pattern generated in a symmetrical round shaped diamond.

It has been discovered, in accordance with the present invention, that the shape of the hearts generated in the hearts and arrows pattern can be substantially enhanced both in symmetry and beauty in comparison to the shape of the hearts generated in U.S. Pat. No. 7,878,025 when the oval shape diamond is polished to include a unique crown star faceting arrangement having a crown star facet containing two facet sections of equal size and geometry in each of the two long and two short sides of the oval shaped diamond and having a crown star facet containing two facet sections of non-equal size and geometry in each of the four diagonal or shoulder sides of the oval shaped diamond. In the preferred embodiment the non-equal parts in each crown star facet on the diagonal sides of the oval shaped diamond are essentially equal to one another in both size and shape respectively.

The improved oval shaped diamond of the subject invention preferably comprises eight main crown facets and eight main pavilion facets with each of the eight main crown facets having a perfectly parallel opposite main crown facet and with each of the eight main crown facets being perfectly aligned with a main pavilion facet positioned on to it. None of the eight main crown facets or eight main pavilion facets should be aligned on the short or long sides of the diamond.

It is also preferred to polish the oval shaped diamond of the subject invention such that none of the eight main crown facets are in alignment with the shape of the oval and, in fact, the diamond should be polished such that four of the eight main crown facets, which lie at least partly on the short side of the diamond, be in substantial misalignment with the shape of the oval and that the other four main crown facets, which lie at least partly on the long side of the diamond, be only slightly misaligned with the shape of the oval. This arrangement results in a highly uneven girdle thickness throughout the diamond, i.e., the girdle thickness varies widely throughout the diamond. However, the degree of variation in the thickness of the girdle is minimized in accordance with the subject invention by further polishing the oval shaped diamond of the subject invention so that it includes a multiple number of subsidiary pavilion facets, preferably twelve in number, with all of the subsidiary pavilion facets located symmetrically on opposite pavilion sides of the diamond extending between its diagonal shoulder sides and with none of the subsidiary pavilion facets lying on either short side of the diamond.

Moreover, the improved oval shaped diamond of the subject invention comprises 16 crown halves (half facets) and that, preferably, sixteen of the crown halves do not meet one other at a point halfway on the main crown facets as is typical in a conventional oval shaped diamond having eight main crown facets and 16 crown halves.

SUMMARY OF THE INVENTION

The oval shaped diamond of the present invention comprises: an oval shape with two long sides and two short sides separated by four diagonal or shoulder sides and further comprises eight main crown facets, eight main pavilion facets, 16 crown and pavilion halves (half facets), multiple subsidiary pavilion facets and a symmetrical arrangement of crown star facets, preferably eight, with two star facets on the short sides of the diamond, two star facets on the long sides of the diamond and four star facets on the diagonal or shoulder sides of the diamond in an arrangement such that each crown star facet on the long and short sides of the diamond include two facet sections of equal size and geometry and each crown star facet on the diagonal or shoulder sides of the diamond include two facet sections of non-equal size and geometry. In the preferred embodiment the non-equal sections in each crown star facet on the diagonal sides of the oval shaped diamond are substantially equal to one another in both size and shape.

Moreover, the position of the eight main crown facets in the oval diamond of the subject invention are preferably offset in relation to the two long and two short sides of the diamond such that four of the eight main crown facets partially lie or extend into the short side of the diamond causing a substantial misalignment of these four main crown facets with the shape of the oval and that the other four main crown facets partially lie or extend into the long side of the diamond and are only slightly misaligned with the shape of the oval. In addition, the oval diamond of the subject invention further comprises a multiple number of subsidiary pavilion facets, optimally twelve, with all of the subsidiary pavilion facets located symmetrically on opposite pavilion sides of the diamond extending between its diagonal or shoulder sides and with none of the subsidiary pavilion facets lying on either short side of the diamond.

BRIEF DESCRIPTION OF THE DRAWINGS

Other advantages will become apparent from the following detailed description of the invention when read in conjunction with the accompanying drawings of which.

DETAILED DESCRIPTION OF THE PREFERRED EMBODIMENT

A diamond is a crystal which functions as a prism for dispersing light by means of reflection and refraction. The traditional oval diamond has eight main crown facets, eight main pavilion facets and sixteen pavilion half facets polished with different angle degrees between the main pavilion facets and the girdle according to their position on the oval shape. In the traditional oval diamond the main pavilion facets and the pavilion half facets are positioned in line with the shape and/or contour of the diamond and the angle degrees selected to cause the girdle to be uniform and of even thickness throughout the diamond.

Figure 1:
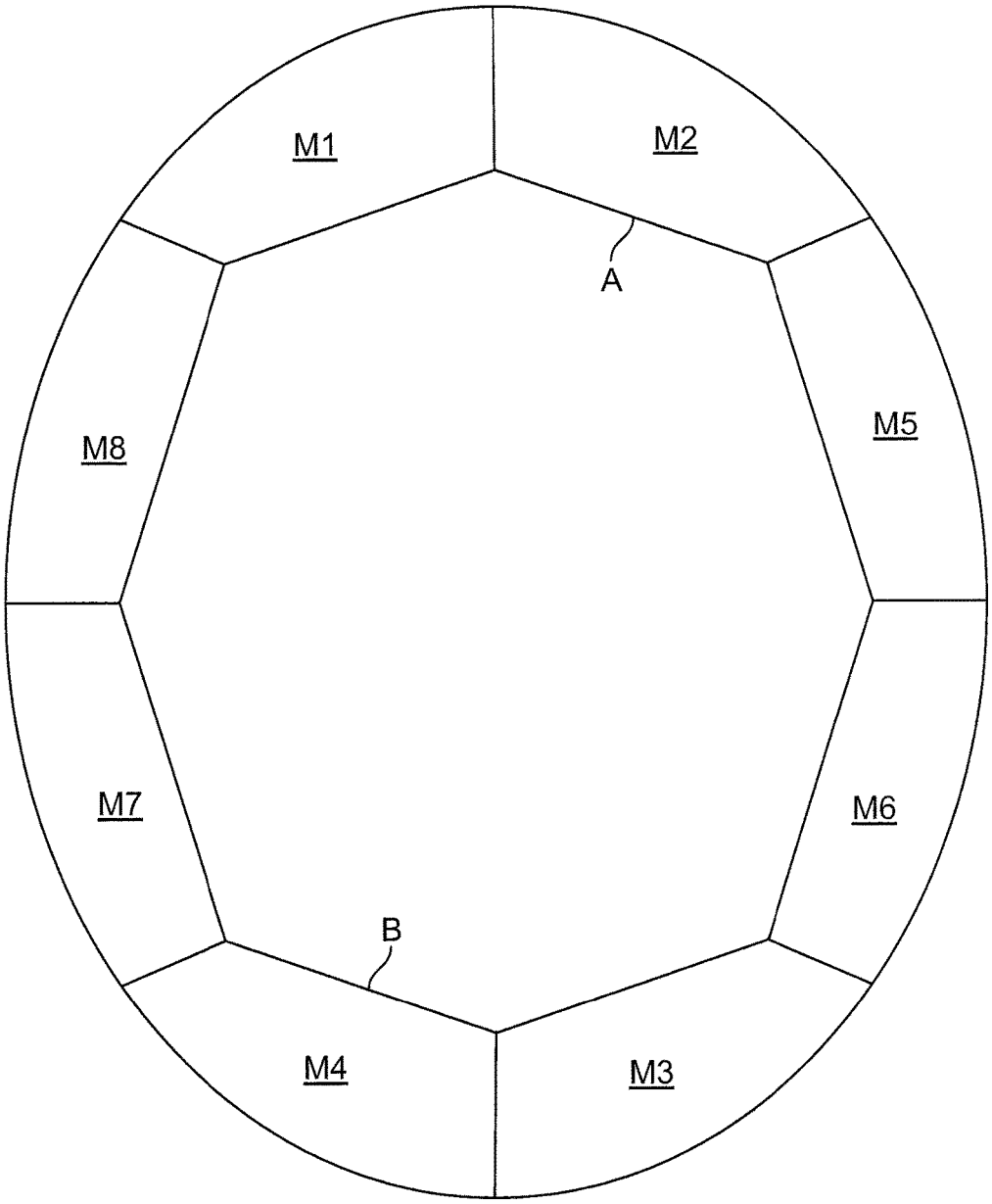
FIG. 1 is an enlarged top view of the oval shaped diamond of the subject invention, from the table facet side, shown during the initial polishing operation of the subject invention, with each of the eight main facets having one straight side edge which lies parallel to a straight side edge of an opposite main crown facet.

The oval shaped diamond of the present invention as is shown in FIGS. 1-4 disregards traditional teaching as to how an oval shaped diamond is cut and also differs from the oval shaped diamond as shown in U.S. Pat. No. 7,878,025, the disclosure of which is incorporated herein by reference. In the oval shaped diamond of the present invention, and as more particularly shown in FIG. 1, the main crown facets M1, M2, M3 and M4, lying closets to the short sides of the diamond, are highly misaligned with the shape of the oval whereas the four main crown facets M5, M6, M7 and M8 are only slightly misaligned to the shape of the oval. Each of the eight main crown facets M1-M8 has one straight side edge which lies parallel to a straight side edge of an opposite main crown facet. For example, as shown in FIG. 1, edge A of main crown facet M2 lies parallel to edge B of main crown facet M4. Moreover, the position of all of the eight main crown facets M1-M8 are offset in relation to the two long and two short sides of the diamond such that each of the long sides of the diamond only partially overlap the main crown facets M5, M6, and M7 and M8 on each opposite side of the diamond and each of the short sides only partially overlap the main crown facets M1, M2, and M3 and M4 on each opposite short side of the diamond respectively. This results in each of the main crown facets M1, M2, M3 and M4 being in substantial misalignment to the shape of the diamond and each of the other four main crown facets M5, M6, M7 and M8 being in slight misalignment to the shape of the diamond in comparison to the misalignment of the main crown facets M1, M2, M3 and M4.

The diagonal or shoulder sides of the diamond are located between the long sides and short sides of the diamond respectively and are analogous to the corner sides in U.S. Pat. No. 7,878,025. However, unlike the oval shaped diamond in U.S. Pat. No. 7,878,025, none of the main crown facets coincide with the short or long sides of the diamond. Instead the four main crown facets M1, M2 and M3, M4 partially overlap both a short side and a diagonal or shoulder side on each opposite side of the diamond respectively. In addition, the main crown facets M5, M6 and M7, M8, partially overlap a long side and a diagonal side on each opposite side of the diamond respectively.

Figure 2:
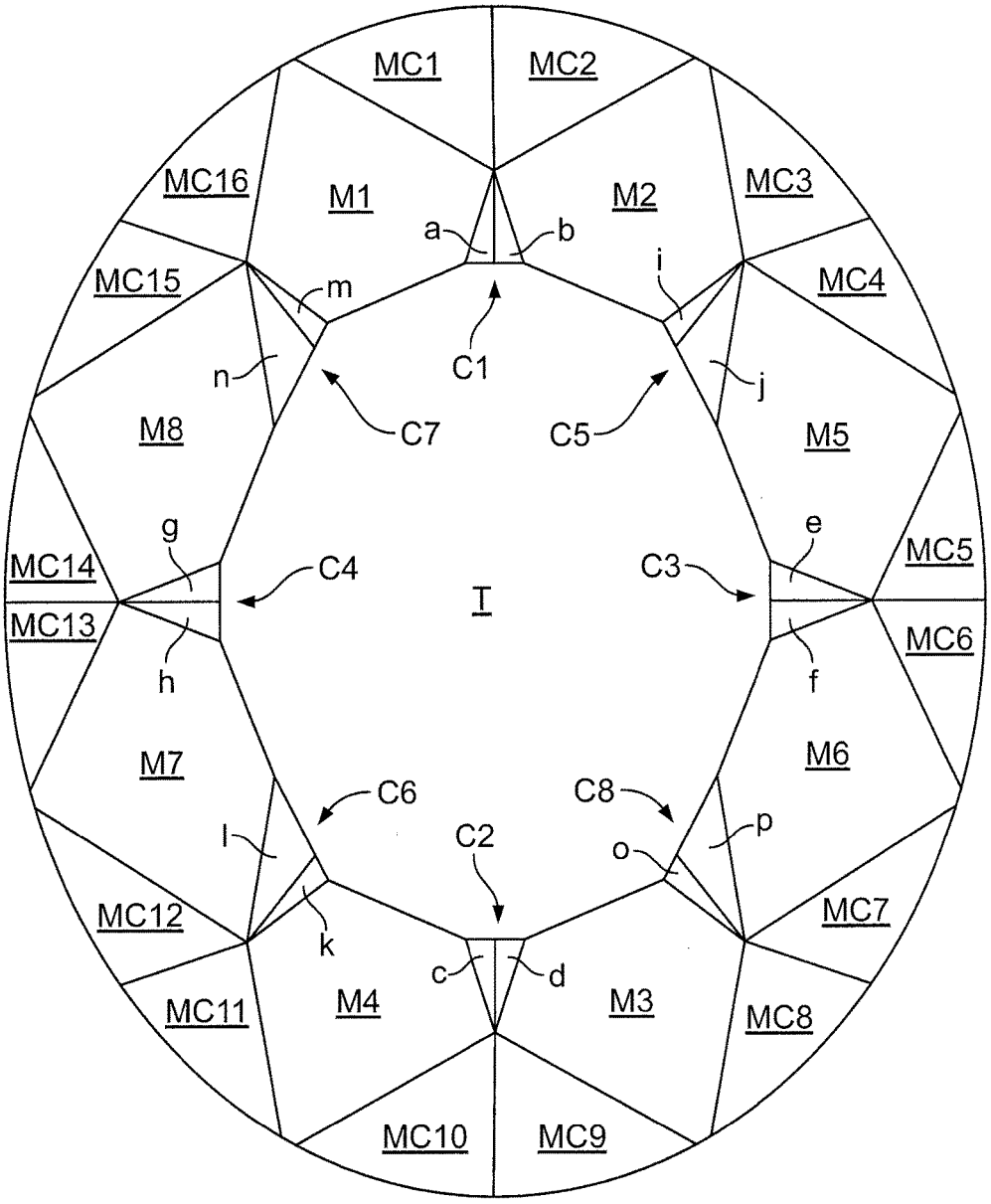
FIG. 2 is a top view of the finished oval shaped diamond of the subject invention, from the table facet side, showing the crown half facets, main crown facets and unique crown star facet arrangement of the subject invention.

The unique crown star faceting arrangement of the subject invention requires each crown star facet to include two facet sections of equal size and geometry in each of the two long and two short sides of the oval shaped diamond and two facet sections of non-equal size and geometry in each of the four diagonal or shoulder sides of the oval shaped diamond. As shown in FIG. 2, the two crown star facets C1 and C2 are aligned with the short sides of the diamond and include two facet sections a,b and c,d respectively with the sections a, b, c and d being equal in size and geometry. Likewise, the two crown facets C3 and C4 are aligned with the long sides of the diamond and include two facet sections e, f and g, h respectively with the sections e, f, g and h being of equal size and geometry. The four crown facets C5, C6, C7 and C8 on the diagonal or shoulder sides of the diamond are dissimilar in size and geometry from the size and shape of the crown star facets C1, C2, C3 and C4 on the short and long sides. The crown star facet C5 and C6 on opposite diagonal sides include two facet sections i, j; and two facet sections k, and l, respectively. Likewise, crown facets C7 and C8, which lie on opposite diagonal sides, each have two facet sections m,n and o,p, respectively. The facet sections i, j, k and l and the facet sections m, n, o and p on the diagonal sides of the diamond are all of equal size and geometry and are substantially larger than the facet sections on the short sides of the diamond. The eight crown main facets M1-M8 and the crown star facets C1-C8 surround the table facet T. FIG. 2 also shows the diamond having sixteen half crown facets with reference numbers MC1-MC16 respectively. The sixteen half crown facets do not meet each other in a point half way on the main crown facets. This ensures that the shape of the arrows do not get distorted.

Figure 3:
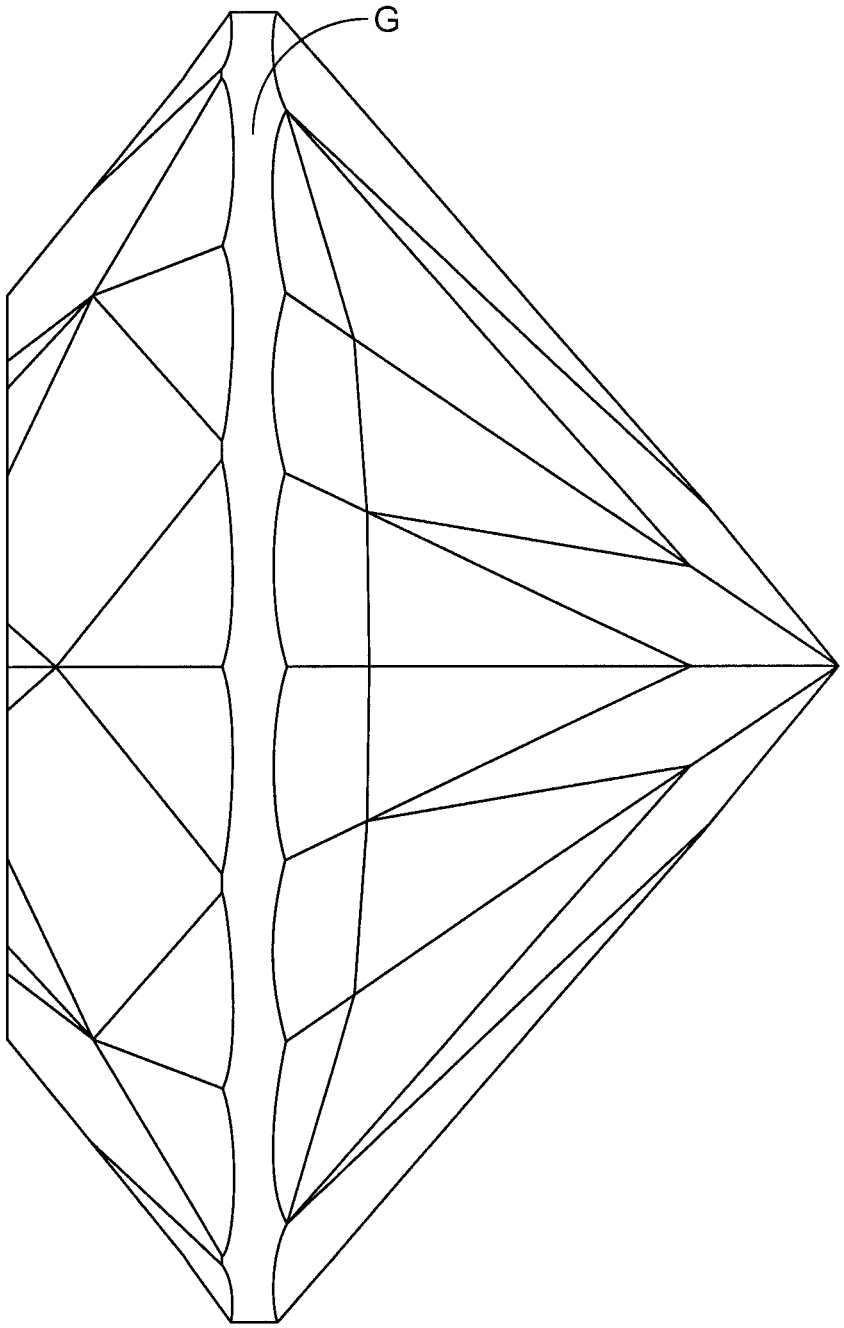
FIG. 3 is a side profile view of the finished oval shaped diamond of the subject invention.
Figure 4:
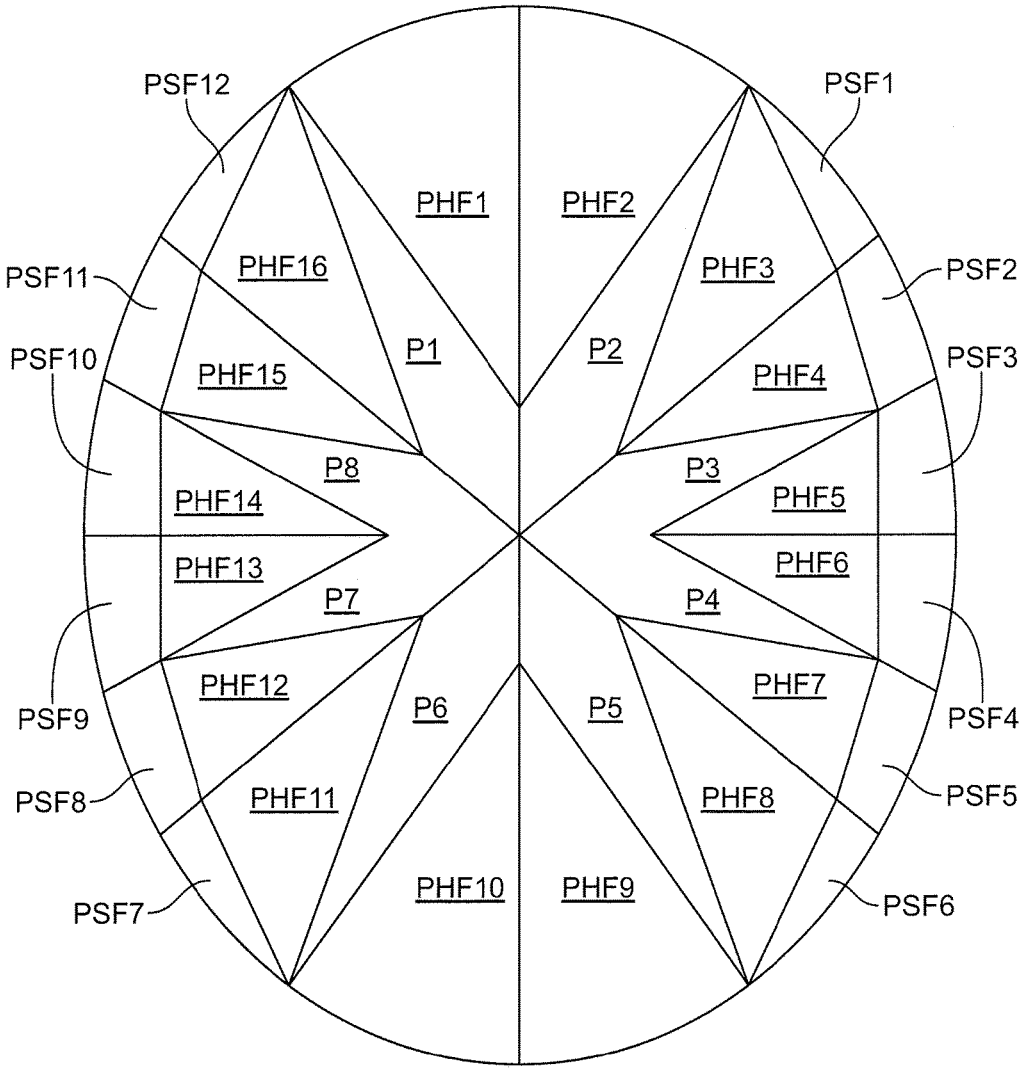
FIG. 4 is a bottom view of the finished oval shaped diamond of the subject invention showing the arrangement of subsidiary pavilion facets on opposite pavilion sides of the diamond.

The pavilion side of the oval diamond of the subject invention as shown in FIG. 4 includes eight main pavilion facets P1-P8, sixteen pavilion half facets PHF1-PHF16 and twelve subsidiary pavilion facets PSF1-PSF12 with all of the subsidiary pavilion facets PSF1-PSF12 located symmetrically on opposite pavilion sides of the diamond. None of the subsidiary pavilion facets PSF1-PSF12 lie on either short side of the diamond and, as such, there are no subsidiary pavilion facets in contact with the pavilion half facets PHF1-PHF2 and PH9 PH10 on the short sides of the diamond. This results in a girdle G as shown in FIG. 3 which varies uniformly in thickness throughout the diamond.

The main crown and pavilion facets are polished with very close but slightly different angle degrees and depth with the objective of providing sufficient light refraction to produce a hearts and arrows pattern.

The oval shaped diamond of the present invention includes the following facets:

| |
|---|
| 8 main crown facets |
| 8 main pavilion facets |
| 16 crown half facets |
| 16 pavilion half facets |
| 8 crown star facets |
| A table facet |
| 12 subsidiary pavilion facets |

In order to obtain a hearts and arrows pattern the main pavilion angles and the main crown angles have to be polished within narrow ranges. Preferably, the main pavilion angles should be within the range of 40.5° to 41.1° and the main crown angles polished between 33.8° to 35.2°. The pavilion half facets should be polished within the angle degree range of 42.0° to 42.6° with the depth of the pavilion half facets on the short side greater than the depth on the long sides and the corner sides, respectively.

To produce an optimal hearts and arrows pattern in an oval shaped diamond, the diamond should be cut to satisfy optimum parameters as set forth in the following Table II:

TABLE II

| | |
|---|---|
| Total Depth: | 62.0%-67.5% |
| Length/width ratio: | 1.15-1.32 |
| Pavillion Depth Average PD: | 43.0%-44.9% |
| Subsidiary pavilion facets: | 65°-73° |
| Crown Height Average: | 14.2%-15.8% |
| Table size: | 53.0%-57.5% |
| Pavilion halves angle: | 42.0°-42.6° |

Pavilion halves height (as measured in distance from girdle to the cutlet point of the diamond) should be in the following range: 71.5%-78.8%
Crown star angle degree range: 7.6°-12.8° flatter than main crown facet angle Crown star facets do not touch each other
Crown halves: 3.2°-8.2° steeper than the main crown facet angle depending on their location
Girdle thickness: 1%-7.5%
Culet must be polished in a point and be perfectly central: tolerance of 0.8% allowed In addition to the above parameters to achieve a hearts and arrows pattern, the diamond facets for optimum beauty should be cut to satisfy the criteria in the following Table III:

TABLE III

Polishing 8 main pavilion facets at a 45° from each other; two main pavilion facets on long sides at 40.9°-41.2°, four main pavilion facets on diagonal sides at 40.6°-40.9°, and 2 main pavilion facets on short sides at 40.4-40.7°
Polishing the subsidiary pavilion facets at an angel degree of 65°-73°
Polishing of 16 pavilion halves: the pavilion halves have to be polished at an angle degree range of 42.0°-42.6°. The pavilion halves facets on the short sides will meet each other at a point relatively close to the culet, the pavilion halves facets on the diagonal sides will also meet each other at a point and the pavilion halves facets on the long sides meet each other at a point relatively close to the culet with each of the points at which the pavilion halves meet being spaced about the same distance from the cutlet.
Polishing of 16 crown halves at a 3.8°-82° steeper than the main pavilion facets depending on their location.

What is claimed is:

1. An oval shaped diamond, adapted to display a hearts and arrows pattern when exposed to light characteristic of the hearts and arrows pattern in a round diamond, comprising: an oval shape having two long sides symmetrical to each other, two short sides symmetrical to each other and four diagonal sides symmetrically located between the long sides and the short sides respectively, eight main crown facets polished at an angle between 33.8° and 35.2°, sixteen crown half facets, eight main pavilion facets polished at an angle between 40.5° and 41.1°; 16 pavilion half facets with each pavilion half facet polished at an angle between 42.0° and 42.6°, a girdle of non-uniform thickness separating the crown and pavilion facets, twelve subsidiary pavilion facets with no subsidiary pavilion facets in contact with pavilion half facets on the short sides on the diamond and eight crown star facets with each crown star facet including two facet sections of equal size and geometry on each of the two long sides and on each of the two short sides of the oval shaped diamond and two facet sections of non-equal size and geometry in each of the four diagonal or shoulder sides of the oval shaped diamond.

2. An oval shaped diamond as defined in claim. 1 wherein at least one of the facet sections of the crown star facets on opposite diagonal sides of the diamond is substantially larger in size than either of the facet sections on the short sides of the diamond.

3. An oval shaped diamond as defined in claim 2 wherein none of the eight main crown facets are fully surrounded by a diagonal or shoulder side of the diamond.

4. An oval shaped diamond as defined in claim 3 wherein said none of the eight main crown facets being surrounded by a diagonal or shoulder side of the diamond results in a girdle having a variable thickness which varies uniformly throughout the diamond.

5. An oval shaped diamond as defined in claim 2 wherein the main pavilion facets are polished at 45° from one another.

6. An oval shaped diamond as defined in claim 5 wherein the subsidiary pavilion facets are polished at angle degrees of between 65° to 73° .

7. An oval shaped diamond as defined in claim 6 wherein the subsidiary pavilion half facets extend only over the diagonal and long sides of the diamond and have no contact with the short side of the diamond.

* * * * *